US010312605B2

(12) United States Patent
Hamada et al.

(10) Patent No.: US 10,312,605 B2
(45) Date of Patent: Jun. 4, 2019

(54) TERMINAL-EQUIPPED WIRE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kazuaki Hamada, Mie (JP); Kenji Miyamoto, Mie (JP); Yasuaki Nakayama, Mie (JP); Kenji Makino, Mie (JP)

(73) Assignees: AutoNetworks Technologies, Ltd., Yokkaichi, Mie (JP); Sumitomo Wiring Systems, Ltd., Yookaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/746,743

(22) PCT Filed: Feb. 10, 2017

(86) PCT No.: PCT/JP2017/004951
§ 371 (c)(1),
(2) Date: Jan. 22, 2018

(87) PCT Pub. No.: WO2018/146797
PCT Pub. Date: Aug. 16, 2018

(65) Prior Publication Data

US 2019/0013593 A1 Jan. 10, 2019

(51) Int. Cl.
*H01R 4/18* (2006.01)
*H01R 13/58* (2006.01)
(Continued)

(52) U.S. Cl.
CPC ..... *H01R 4/18* (2013.01); *H01R 4/185* (2013.01); *H01R 9/0518* (2013.01); *H01R 13/58* (2013.01);
(Continued)

(58) Field of Classification Search
CPC ... H01R 13/183; H01R 13/187; H01R 13/188
(Continued)

(56) References Cited

U.S. PATENT DOCUMENTS 3,146,519 A * 9/1964 Redwine ..... H01R 43/058 174/84 C
5,561,267 A * 10/1996 Fudoo ..... H01R 4/185 174/84 C
(Continued)

FOREIGN PATENT DOCUMENTS

JP 2006147223 A 6/2006
JP 2009037743 A 2/2009

*Primary Examiner* — Tulsidas C Patel
*Assistant Examiner* — Peter G Leigh
(74) *Attorney, Agent, or Firm* — Reising Ethington, P.C.

(57) ABSTRACT

A terminal-equipped wire configured by crimping a pair of barrel pieces provided on a terminal to an external sheath of a wire, the external sheath being provided on an outer circumferential surface of a core wire. The pair of barrel pieces are wrapped around the external sheath into a polygonal tube shape that has a plurality of corner portions in a circumferential direction of the external sheath, leading end edges of the pair of barrel pieces are arranged on opposite sides of at least one corner portion out of the plurality of corner portions.

4 Claims, 17 Drawing Sheets

(51) Int. Cl.
*H01R 9/05* (2006.01)
*H01R 13/648* (2006.01)
*H01R 24/56* (2011.01)
*H01R 43/048* (2006.01)

(52) U.S. Cl.
CPC ..... *H01R 13/648* (2013.01); *H01R 24/568* (2013.01); *H01R 43/048* (2013.01); *H01R 43/0482* (2013.01)

(58) Field of Classification Search
USPC ..... 439/877
See application file for complete search history.

(56) References Cited

U.S. PATENT DOCUMENTS 6,709,290 B2 * 3/2004 Yoshida ..... H01R 9/0518 439/585
6,808,417 B2 * 10/2004 Yoshida ..... H01R 9/0518 439/585
7,207,850 B2 * 4/2007 Takayama ..... H01R 4/185 439/850
7,762,841 B2 * 7/2010 Ho ..... H01R 9/0518 439/582
7,775,842 B2 * 8/2010 Yamagami ..... H01R 43/058 439/877
7,909,647 B2 * 3/2011 Kawaguchi ..... H01R 9/035 439/585
8,070,536 B2 * 12/2011 Ono ..... H01R 4/185 439/877
8,221,171 B2 * 7/2012 Ono ..... H01R 4/185 439/877
8,827,744 B2 * 9/2014 Poma ..... H01R 4/20 439/585
9,136,628 B2 * 9/2015 Aizawa ..... H01R 4/185
9,397,410 B2 * 7/2016 Corman ..... H01R 4/185
9,502,785 B2 * 11/2016 Schmidt ..... H01R 4/183
2003/0049956 A1 * 3/2003 Yoshida ..... H01R 9/0518 439/98
2005/0266727 A1 * 12/2005 Yamaguchi ..... H01R 9/0518 439/585
2009/0035991 A1 2/2009 Sakaguchi et al.
2010/0068927 A1 3/2010 Ho
2013/0171873 A1 * 7/2013 Kanda ..... H01R 13/6581 439/607.51
2016/0172769 A1 * 6/2016 Kamoshida ..... H01R 4/62 439/877
2016/0190711 A1 * 6/2016 Kamoshida ..... H01R 4/62 439/877
2016/0365674 A1 * 12/2016 Abe ..... H01R 4/185
2017/0018858 A1 * 1/2017 Ohnuma ..... H01R 4/185

* cited by examiner

TERMINAL-EQUIPPED WIRE

TECHNICAL FIELD

The technology disclosed in the present specification is related to a terminal-equipped wire.

BACKGROUND ART

The structure disclosed in Patent Document 1 (JP2009-37743A) below is known as a conventional example of a structure at an end of a wire. This structure is formed by connecting an inner terminal 1 and an outer terminal 2 to an end of a wire 10, which is formed by concentrically layering an internal insulating layer 12, a shield layer 13, and an external sheath 14 on the outer circumferential surface of a core wire 11, from the inside out (see FIGS. 15 and 16).

More specifically, a structure is employed in which the end of the wire 10 is stripped off to expose the core wire 11, the internal insulating layer 12, and the shield layer 13 in a step-like manner, the inner terminal 1 is connected to the core wire 11, a crimp portion constituted by a pair of barrel pieces 3 provided on the outer terminal 2 is wrapped around the end of the shield layer 13, and the outer terminal 2 is crimped to the end of the shield layer 13.

SUMMARY

However, when such a wire 10 with a terminal connected thereto is subjected to a tensile load in a direction orthogonal to the axial direction, there may be cases where the pair of barrel pieces 3 attempt to open (see FIG. 17). For this reason, a configuration has been proposed in which the wire 10 is passed through an annular sleeve, and the barrel pieces 3 are crimped onto a braided member having the sleeve as an underlayer, or the barrel of the terminal is formed as a closed barrel, thus improving the fixing strength of the crimping portion.

However, in addition to needing to pass the wire 10 through the annular-shaped part, processing such as cutting and welding needs to be performed on parts, which leads to an increase in costs, thus leaving room for improvement in terms of workability and manufacturing cost.

The technology disclosed in the present specification was realized based on the circumstances described above, and it is an object of the present application to provide a terminal-equipped wire with high fixing strength, and that is excellent in terms of workability and manufacturing cost.

The technology disclosed in the present specification provides a terminal-equipped wire configured by crimping a pair of barrel pieces provided on a terminal to an external sheath of a wire, the external sheath being provided on an outer circumferential surface of a core wire, in which the pair of barrel pieces are wrapped around the external sheath into a polygonal tube shape that has a plurality of corner portions in a circumferential direction of the external sheath, and leading end edges of the pair of barrel pieces are arranged on opposite sides of at least one corner portion out of the plurality of corner portions.

With this configuration, a configuration is employed in which the pair of barrel pieces are crimped to the external sheath into a polygonal tube, i.e. a cross-sectional polygonal shape, and thus the wire is strongly crimped discontinuously in the circumferential direction thereof, and excellent fixing strength is exhibited. Also, the leading end edges of the pair of barrel pieces are arranged so as to be on opposite sides of at least one corner portion out of the plurality of corner portions, and therefore, even if an external force is applied to the wire in the direction in which the pair of barrel pieces open, the pair of barrel pieces catch on the corner portion and are unlikely to open. In other words, higher fixing strength is exhibited compared to a conventional structure in which a barrel is wrapped into a curved cross-sectional shape around a wire.

Also, with such a terminal-equipped wire, similarly to conventional art, it is sufficient to wrap the pair of barrel pieces around the end of the wire, and thus this configuration is excellent in terms of workability and manufacturing cost.

The above-described terminal-equipped wire may employ the following configurations.

A configuration may be employed in which the wire includes a shield layer between the core wire and the external sheath, the shield layer is exposed at an end of the wire and folded back onto an outer circumferential surface of the external sheath, and the pair of barrel pieces are crimped to the external sheath via the shield layer.

Also, a configuration may be employed in which mutually matching abutting edge portions of the pair of barrel pieces have an uneven shape on a leading end side in an extension direction of the barrel pieces.

With this configuration, even if a mode is employed in which the pair of barrel pieces abut against each other, the barrel pieces are unlikely to easily open because portions near the leading end edge of each barrel piece are formed so as catch on a corner portion. Note that an uneven shape also includes a stepped shape in the shape of steps.

Also, a configuration may be employed in which an outer barrel is crimped to the pair of barrel pieces from the outside, and a pair of leading end edges of the outer barrel are arranged on opposite sides of at least one corner portion out of the plurality of the corner portions.

With such a configuration, the wire is crimped by the pair of barrel pieces and the outer barrel described above, and therefore the fixing strength between the terminal and the wire can be improved. Furthermore, the outer barrel is also formed so as to catch on corner portions, thus further improving the fixing strength.

Furthermore, a configuration may be employed in which the abutting edge portions of the pair of barrel pieces and the pair of leading end edges of the outer barrel are arranged at different positions in a circumferential direction of the wire.

With this configuration, even if an external force is applied to the wire in any direction, the pair of barrel pieces can be made to be less likely to open.

Also a configuration may be employed in which the terminal includes an inner terminal connected to the core wire, a dielectric that houses the inner terminal therein, and an outer terminal that has a housing portion that houses the dielectric, when divided along an extension direction of the housing portion, the housing portion of the outer terminal includes a first member and a second member, and the pair of barrel pieces are provided integrated with the first member and the outer barrel is provided integrated with the second member.

Accordingly, due to the outer barrel being provided integrated with the originally used second member, an increase in the number of parts can be avoided.

Furthermore, a configuration may also be employed in which the pair of barrel pieces overlap each other at leading end sides thereof. With this configuration, a terminal with the same shape as that in the conventional technology can be used.

With the technology disclosed in the present specification, a terminal-equipped wire with high fixing strength, and that is excellent in terms of workability and manufacturing cost can be provided.

DESCRIPTION OF EMBODIMENTS

Embodiment 1

A terminal-equipped wire 100 according to Embodiment 1 will be described based on FIGS. 1 to 5. In the present embodiment, as shown in FIG. 1, a terminal 20 is connected to an end of a shielded wire 10.

Figure 1:
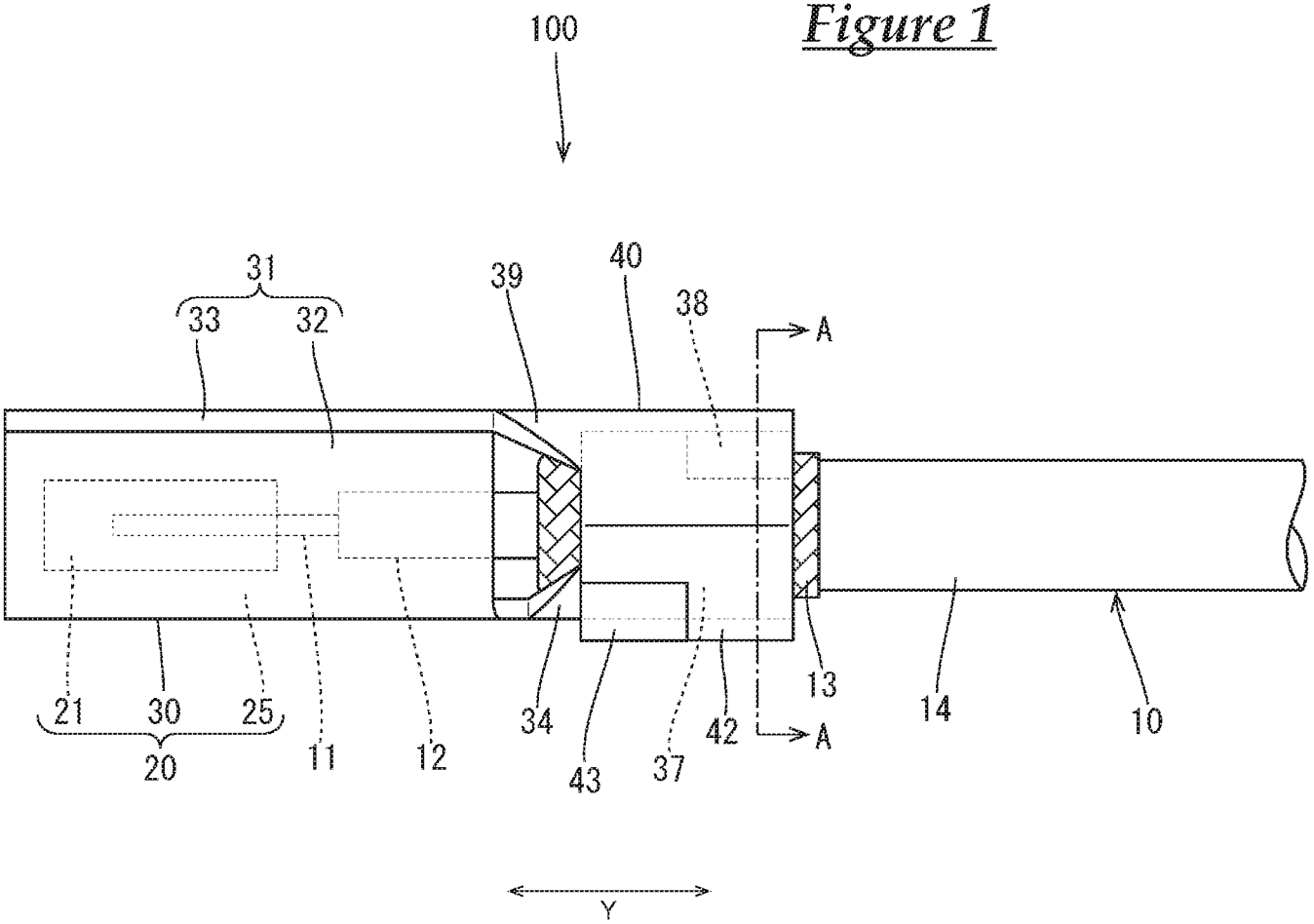
FIG. 1 is a side view of a terminal-equipped wire according to Embodiment 1.

Note that in the following description, the left side of FIG. 1 is the front side and the up-down direction of FIG. 1 defines the upper and lower sides.

Figure 5:
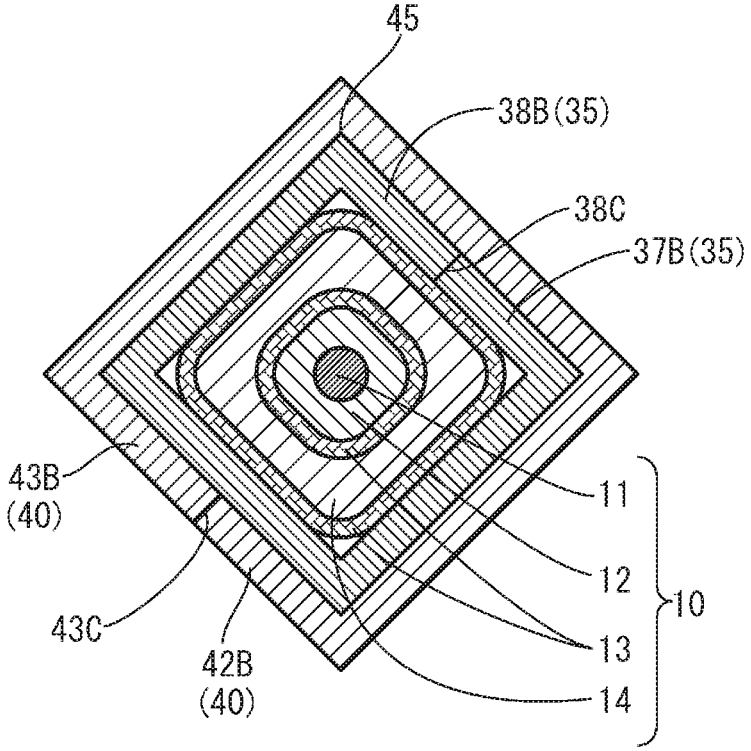
FIG. 5 is a cross-sectional view taken along line A-A in FIG. 1.

The shielded wire 10 has a structure in which a core wire 11 made of a single metal element wire or a twisted wire made of a plurality of metal element wires twisted together, a comparatively thick internal insulating layer 12, a shield layer 13 made of braided wires, and an external sheath 14 that is made of an insulating material such as a synthetic resin are arranged coaxially from the inside out (see FIG. 5).

End processing such as stripping is performed on the end of the shielded wire 10, and the ends of the core wire 11, the internal insulating layer 12, and the shield layer 13 are exposed in a step-like manner. Also, the exposed shield layer 13 is folded back onto the outside of the external sheath 14 (see FIG. 1).

The terminal 20 includes an inner terminal 21 connected to the core wire 11, an outer terminal 30 connected to the shield layer 13, and a dielectric (example of an insulator) 25 interposed between the inner terminal 21 and the outer terminal 30.

The inner terminal 21 is formed by pressing a metal plate that has excellent electrical conductivity, and can be connected to a partner terminal that is not shown. The dielectric 25 is for electrically insulating the inner terminal 21 and the outer terminal 30, and is made of an insulating material such as a synthetic resin. Also, the inner terminal 21 described above is configured to be inserted into an internally provided housing chamber from the rear side, and to be housed therein so as to not come loose.

Figure 2:
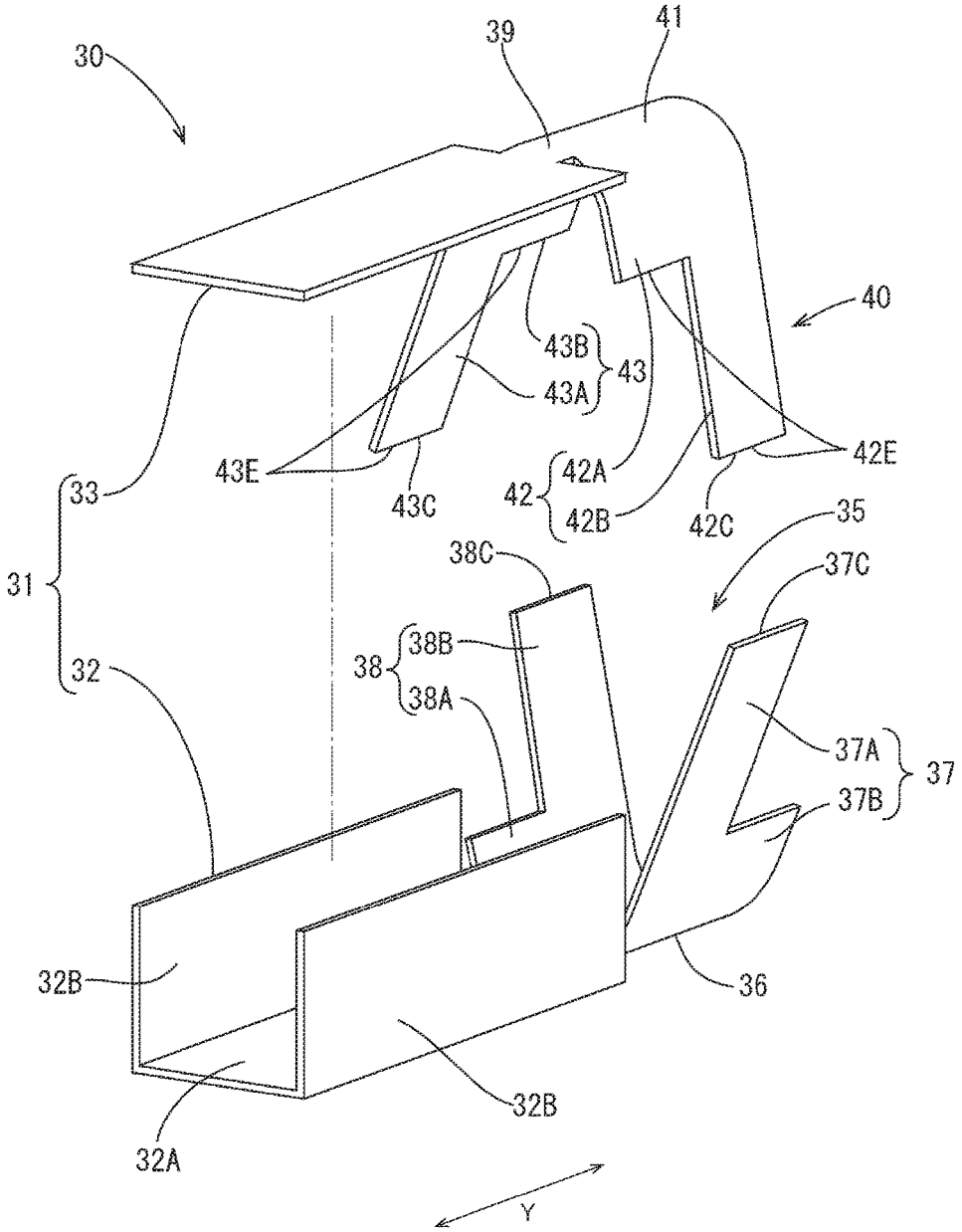
FIG. 2 is an exploded perspective view of an outer terminal.

As shown in FIG. 2, the outer terminal 30 is similarly formed by pressing a metal plate that has excellent electrical conductivity, and the front side portion is a fitting tube portion 31 (an example of a housing chamber) into which the above-described dielectric 25 is fitted. The fitting tube portion 31 has an elongated rectangular tube shape, and has a configuration including, when divided along an extension direction Y, a body portion 32 (example of first member) with a U-shaped cross section formed by a bottom wall portion 32A and a pair of side wall portions 32B, and a rectangular plate-shaped lid portion 33 (example of second member) that closes off a face opposing the bottom wall portion 32A. The lid portion 33 is configured to be locked to the body portion 32 via a locking mechanism that is not shown.

The fitting tube portion 31 can be fitted and connected to a fitting tube portion of a partner terminal (not shown). The fitting tube portion 31 is configured such that the above-described dielectric 25 can be inserted backwards from an opening on the front side and housed so that it does not come loose therefrom.

A barrel portion 35 that is to be crimped to the end of the shield layer 13 is provided on the rear side of the bottom wall portion 32A of the fitting tube portion 31. The barrel portion 35 includes a placement portion 36 that extends rearward from the bottom wall portion 32A of the fitting tube portion 31 via a linking portion 34 provided extending from the bottom wall portion 32A, and a pair of barrel pieces 37 and 38 that are provided extending laterally from the two side edges of the placement portion 36.

Figure 3:
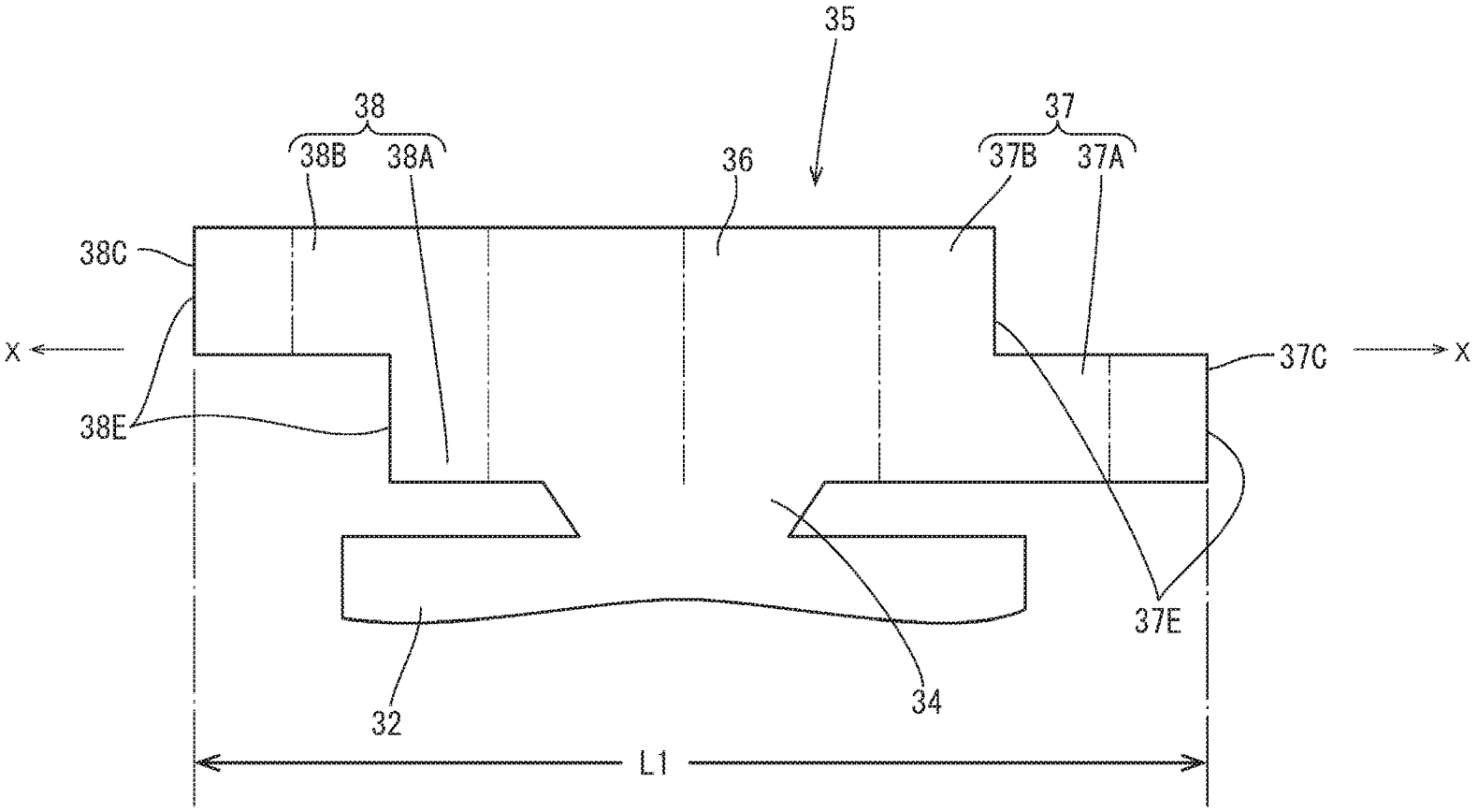
FIG. 3 is a laid-out plan view of a barrel portion of the outer terminal.

Below, out of the pair of barrel pieces, the barrel piece on the right side in FIGS. 2 and 3 is the first barrel piece 37 and the barrel piece on the left side is the second barrel piece 38.

As shown in FIG. 3, the pair of barrel pieces 37 and 38 extend laterally from the placement portion 36 substantially in an L-shape. More specifically, a region that is approximately half of the first barrel piece 37, on the front side (lower side in FIG. 3), is a long portion 37A that has the longer protrusion dimension, and a region that is approximately half thereof on the rear side (upper side in FIG. 3) is a short portion 37B that has the shorter protrusion dimension. On the other hand, a region that is approximately half of the second barrel piece 38, on the front side, is a short portion 38A with the shorter protrusion dimension, and the region that is approximately half thereof on the rear side is a long portion 38B that has the longer protrusion dimension.

The protrusion dimensions of the long portions 37A and 38B from the placement portion 36 are equivalent, and the protrusion dimensions of the short portions 37B and 38A from the placement portion 36 are equivalent. Also, a length dimension L1 between leading end edges 37C and 38C of the pair of barrel pieces 37 and 38 (see FIG. 3) is set to a length dimension that allows the shielded wire 10 to be compressed at a predetermined compression rate when the barrel portion 35 is crimped to the shielded wire 10 and the entirety of the edge portions on the leading end sides of the pair of barrel pieces 37 and 38 (hereinafter, abutting edge portions 37E and 38E) abut against each other. Note that the leading end edges 37C and 38C of the barrel pieces 37 and 38 refer to the leading end edges of the long portions 37A and 38B of the barrel pieces 37 and 38.

Figure 4:
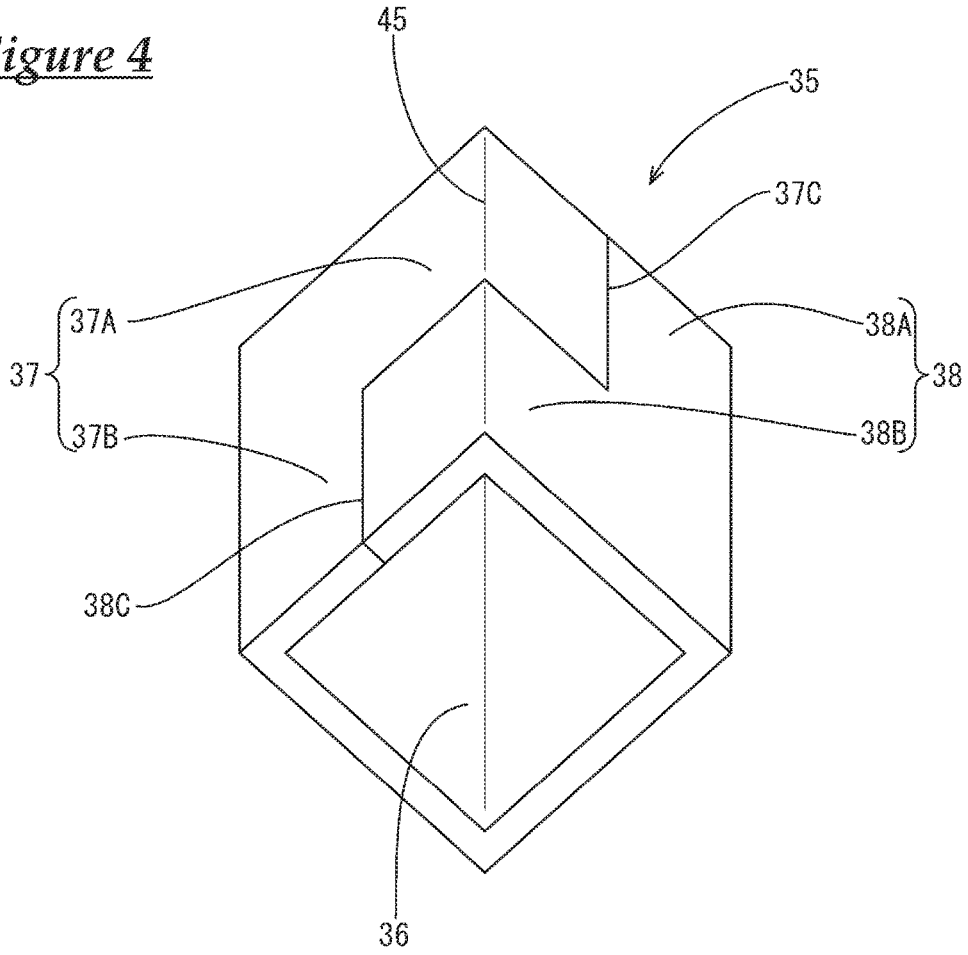
FIG. 4 is a conceptual perspective view of the barrel portion in a wrapped state, shown from a rear side.

FIG. 4 shows a conceptual view of the pair of barrel pieces 37 and 38 in an assembled state, seen from the rear side. The pair of barrel pieces 37 and 38 are crimped to the external sheath 14 of the shielded wire 10 into a rectangular shape, that is to say, a rectangular tube that has four corner portions in the circumferential direction. In this state, the leading end edges 37C and 38C of the pair of barrel pieces 37 and 38 are arranged on opposite sides of a corner portion 45 (an example of a corner portion), which is arranged on the upper side in FIG. 4.

Also, the abutting edge portions 37E and 38E (leading end sides of barrel portions 37 and 38 in extension direction X) of the barrel portions 37 and 38 have a stepped shape, which allows the pair of barrel pieces 37 and 38 to abut against and fit each other. Note that the broken lines in FIG. 3 indicate a fold (corner portion).

On the other hand, as shown in FIG. 2, an outer barrel 40 that is to be externally crimped to the barrel portion 35 is provided integrated with the above-described lid portion 33 on the rear side thereof. The outer barrel 40 includes a covering portion 41 that extends rearward from the lid portion 33 via a second linking portion 39 provided extending from the lid portion 33, and a pair of outer barrel pieces 42 and 43 extending laterally from the two side edges of the covering portion 41.

Below, out of the pair of outer barrel pieces 42 and 43, the outer barrel piece on the right side in FIG. 2 is the first outer barrel piece 42 and the outer barrel piece on the left side is the second outer barrel piece 43.

The pair of outer barrel pieces 42 and 43 extend laterally from the covering portion 41 substantially in an L-shape, similarly to the above-described pair of barrel pieces 37 and 38. More specifically, a region that is approximately half of the first outer barrel piece 42, on the front side, is a short portion 42A that has the shorter protrusion dimension, and the region that is approximately half thereof on the rear side is a long portion 42B that has the longer protrusion dimension. On the other hand, a region that is approximately half of the second outer barrel piece 43, on the front side, is a long portion 43A that has the longer protrusion length, and the region that is approximately half thereof, on the rear side, is a short portion 43B that has the shorter protrusion dimension.

That is to say, the above-described barrel portion 35 of the body portion 32 and the outer barrel 40 of the lid portion 33 are configured such that the protrusion dimensions (lengths) of respective barrel pieces are opposite (reverse) when the shielded wire 10 is crimped.

The protrusion lengths of the long portions 42B and 43A from the covering portion 41 are equivalent, and the protrusion lengths of the short portions 42A and 43B from the covering portion 41 are equivalent. Also, a length dimension between leading end edges 42C and 43C of the pair of outer barrel pieces 42 and 43 (the length dimension in the direction orthogonal to the extension direction of the outer terminal 30 (extension direction Y of fitting tube 31)) is set to be somewhat larger than the length dimension L1 in the same direction between the leading end edges 37C and 38C of the barrel pieces 37 and 38 described above, and the outer barrel 40 is configured to snugly conform to the outer surface of the barrel portion 35 while the entirety of the edge portions on the leading end sides of the outer barrel pieces 42 and 43 abut against each other when the shielded wire 10 is crimped. Note that the leading end edges 42C and 43C of the outer barrel pieces 42 and 43 refer to the leading end edges of the long portions 42B and 43A of the outer barrel pieces 42 and 43.

As shown in FIG. 2, the pair of barrel pieces 37 and 38 take on a posture of being open upward when the terminal 20 stands on its own, and are configured to be crimped so as to wrap around the end of the shield layer 13. Also, the pair of outer barrel pieces 42 and 43 take on a posture of being open downward when the terminal 20 stands on its own, and are configured to be crimped so as to wrap around the outer circumferential surface of the pair of barrel pieces 37 and 38 when the pair of barrel pieces 37 and 38 are crimped to the terminal of the shield layer 13 (see FIG. 5).

In this state, the leading end edges 37C and 38C of the pair of barrel pieces 37 and 38 and the leading end edges 42C and 43C of the outer barrel pieces 42 and 43 are arranged at positions different to each other in the circumferential direction of the shielded wire 10. In the present embodiment, they are arranged at opposing positions (see FIG. 5)

According to the above-described embodiment, a configuration is employed in which the pair of barrel pieces 37 and 38 are crimped into a polygonal tube shape, that is to say, a cross-sectional polygonal shape, to the shield layer 13 (shielded wire 10), and thus the shielded wire 10 is strongly crimped discontinuously in the circumferential direction thereof, and excellent fixing strength is exhibited. Also, the leading end edges 37C and 38C of the pair of barrel pieces 37 and 38 are arranged on opposite sides of one corner portion 45 out of four corner portions, and therefore, even if an external force is applied to the shielded wire 10 in the direction in which the pair of barrel pieces 37 and 38 open, each of the pair of barrel pieces 37 and 38 becomes caught on a corner portion 45 and is unlikely to open. That is to say, high fixing strength is exhibited.

Also, in such a terminal-equipped wire, similarly to conventional technology, it is sufficient to wrap the pair of barrel pieces 37 and 38 around the shielded wire 10 and crimp them, thus realizing excellence in terms of workability and manufacturing cost.

Also, the barrel pieces 37 and 38 are unlikely to easily open because the mutually matching abutting edge portions 37E and 38E of the pair of barrel pieces 37 and 38 each have an uneven shape (stepped shape) on the leading end sides of the barrel pieces 37 and 38 in the extension direction X and fit each other, and thus portions near the leading end edges of the barrel pieces 37 and 38 catch on the corner portion 45.

Furthermore, the outer barrel 40 is crimped onto the pair of barrel pieces 37 and 38 from the outside, and the leading end edges 42C and 43C of the pair of outer barrel pieces 42 and 43 are arranged on opposite sides of one corner portion, out of four corner portions, and thus the shielded wire 10 is crimped by both the above-described pair of barrel pieces 37 and 38 and the outer barrel pieces 42 and 43. Accordingly, the fixing strength between the outer terminal 30 and the shielded wire 10 can be further increased.

Furthermore, the abutting edge portions 37E and 38E of the pair of barrel pieces 37 and 38 and the pair of leading end edges 42C and 43C of an outer barrel 40 are arranged at different positions from each other in the circumferential direction of the shielded wire 10, and thus, even if an external force is applied to the shielded wire 10 in any direction, the pair of barrel pieces 37 and 38 can be made less likely to open.

Also, the fitting tube portion 31 of the outer terminal 30 is configured by combining the body portion 32 and the lid portion 33, and the pair of barrel pieces 37 and 38 are provided integrated with the body portion 32, and the outer barrel 40 is provided integrated with the lid portion 33. That is to say, because the outer barrel 40 is provided integrated with the originally required lid portion 33, an increase in the number of parts can be avoided.

Embodiment 2

Figure 6:
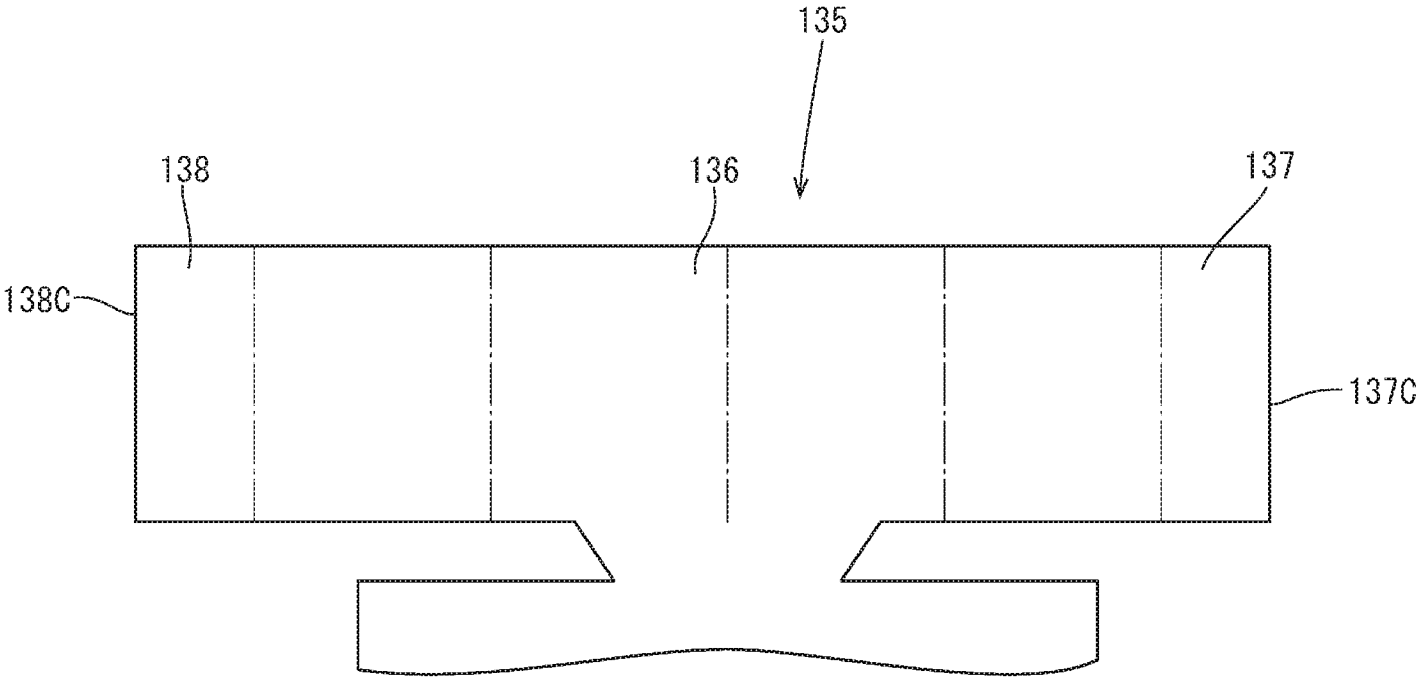
FIG. 6 is a laid-out plan view of a barrel portion of an outer terminal according to Embodiment 2.
Figure 7:
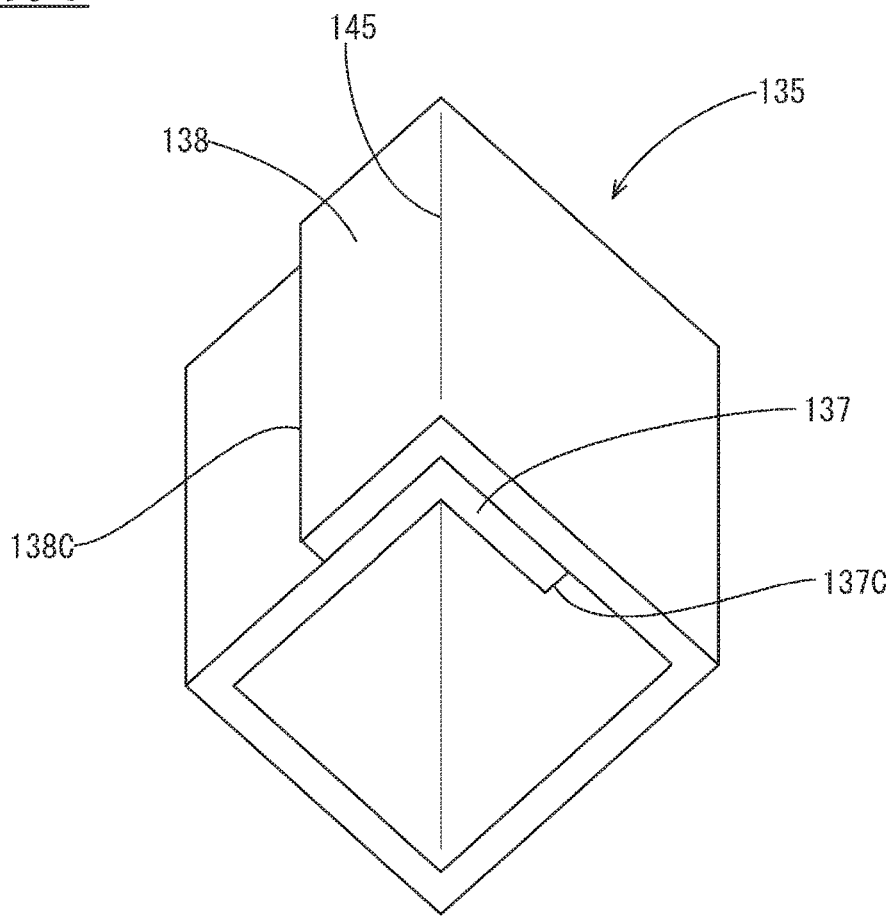
FIG. 7 is a conceptual perspective view of the barrel portion in a wrapped state, shown from a rear side.

A terminal-equipped wire according to Embodiment 2 will be described based on FIGS. 6 and 7. Note that only constituent elements different from those of Embodiment 1 are described below, and constituent elements the same as those in Embodiment 1 have been given the same reference numerals, thereby omitting redundant descriptions.

The terminal-equipped wire in Embodiment 2 is different from that in the above-described Embodiment 1 in terms of the mode of a pair of barrel pieces 137 and 138 of a barrel portion 135. The leading end sides of the pair of barrel pieces 137 and 138 of the present embodiment have a simple rectangular shape, and the length dimension (length of lateral protrusion from placement portion 136) of the first barrel piece 137 is set to be longer than the length dimension of the first barrel piece 37 in Embodiment 1. Also, in a state in which the barrel portion 135 is crimped to the shielded wire 10, as shown in FIG. 7, only a predetermined length dimension of each leading end side of the pair of barrel pieces 137 and 138 is placed on the other, and a so-called overlap is formed. Also, the outer barrel is not crimped.

Even with a terminal-equipped wire such as that of Embodiment 2, similarly to the above-described Embodiment 1, the shielded wire 10 is strongly crimped discontinuously in the circumferential direction thereof, and excellent fixing strength is exhibited. Also, a configuration is employed in which leading end edges 137C and 138C of the pair of barrel pieces 137 and 138 are arranged on opposite sides of one corner portion 145 out of four corner portions, and thus, even if an external force is applied to the wire in a direction in which the pair of barrel pieces 137 and 138 open, the barrel pieces 137 and 138 catch on the corner portion 145 and are unlikely to open. That is to say, high fixing strength is exhibited.

Embodiment 3

A terminal-equipped wire 300 according to Embodiment 3 will be described using FIGS. 8 and 9. Only constituent elements different to Embodiment 1 are described below. Also, configurations similar to those of Embodiment 1 are denoted by adding 40 to the same reference numerals in Embodiment 1, thereby omitting redundant descriptions.

The terminal-equipped wire 300 of Embodiment 3 includes a wire 60 in which a sheath 64 is provided on the outer circumferential surface of a core wire 61 that is a bundled plurality of element wires, and a terminal 70 that is connected to an end of the wire 60.

Figure 8:
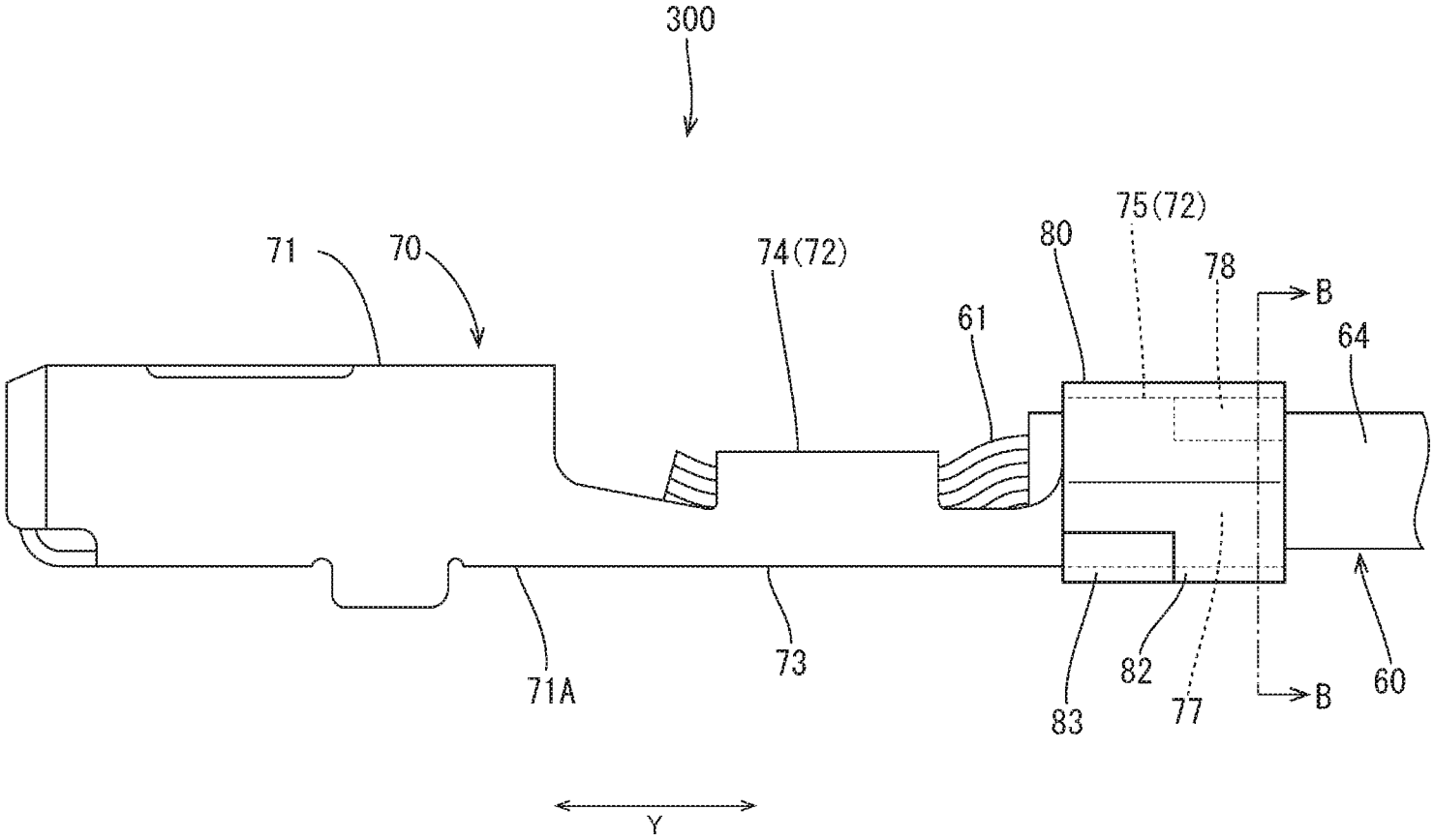
FIG. 8 is a side view showing a terminal-equipped wire according to Embodiment 3.
Figure 9:
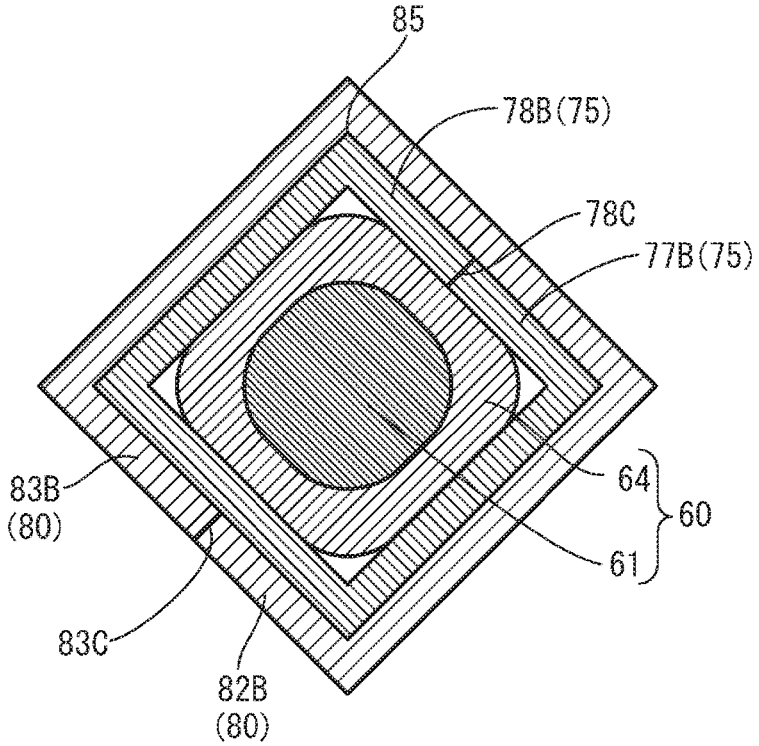
FIG. 9 is a cross-sectional view taken along line B-B in FIG. 8.

The terminal 70 is formed by pressing a metal plate that has excellent electrical conductivity, and, as shown in FIG. 8, includes a fitting tube portion 71 that has an approximate box shape that is open at the front and rear sides, and can receive a partner male terminal. A wire connecting portion 72 on which a wire 60 is placed and connected is provided on the rear side of the fitting tube portion 71.

The wire connecting portion 72 has two barrels 74 and 75 that are provided spaced apart from each other and are formed protruding laterally from a placement portion 73 provided extending from the rear end of a bottom wall 71A of the fitting tube portion 71. Out of the two barrels 74 and 75, the one on the front side is the wire barrel 74 crimped to the core wire 61, and the one on the rear side is the insulation barrel 75 crimped to the sheath 64.

The wire barrel 74 is crimped so that the leading end portions of a pair of wire barrel pieces bite into the core wire 61.

On the other hand, the insulation barrel 75 has a pair of insulation barrel pieces 77 and 78, and is crimped such that these insulation barrel pieces 77 and 78 are wrapped around the sheath 64 from both sides.

The insulation barrel 75 in the present embodiment has the same mode as the first barrel portion 35 of the above-described Embodiment 1. That is to say, the pair of insulation barrel pieces 77 and 78 have a stepped shape on the leading end sides thereof, and are wrapped around the sheath 64 of the wire 60 into a rectangular tube shape that has four corner portions in the circumferential direction, that is to say, a shape with a square cross section (see FIG. 9). Also, leading end edges 77C and 78C of the pair of insulation barrel pieces 77 and 78 in the extension direction X are arranged on opposite sides of one corner portion 85 out of the four corner portions.

Also, an outer barrel 80 is crimped to the pair of insulation barrel pieces 77 and 78 from the outside. The outer barrel 80 has the same shape as the outer barrel 40 in Embodiment 1, but is different from that in Embodiment 1 in that it is separate from the terminal 70 and formed as a standalone body.

The outer barrel 80 in the present embodiment has the same mode as the outer barrel 40 in the above-described Embodiment 1. That is to say, a pair of outer barrel pieces 82 and 83 have a stepped shape on the leading end sides thereof, and their length dimensions (length) are set such that the length dimension of one of the barrel pieces 82 and 83 is opposite (reverse) to the other when mutually matched.

Also, the length dimension between leading end edges 82C and 83C of the outer barrel 80 (length dimension in direction orthogonal to extension direction Y of the terminal 70) is set to be somewhat longer than the length dimension in the same direction between the leading end edges 77C and 78C of the above-described insulation barrel 75, and the length dimension is set such that, when crimped to the wire 60, the outer barrel 80 snugly conforms to the outer circumferential surface of the insulation barrel 75, and the entirety of the edge portions on the leading end sides of the outer barrel pieces 82 and 83 abut against each other.

Even in a terminal-equipped wire 300 such as that in Embodiment 3, similarly to Embodiment 1, the insulation barrel 75 of the terminal 70 can be strongly crimped discontinuously to the wire 60 in the circumferential direction thereof, and excellent fixing strength is exhibited. Also, a configuration is employed in which the leading end edges 77C and 78C of the pair of insulation barrel pieces 77 and 78 are arranged on opposite sides of one corner portion 85 out of four corner portions, and thus, even if an external force is applied to the pair of insulation barrel pieces 77 and 78 in an opening direction, the insulation barrel pieces 77 and 78 catch on the corner portions 85 and are unlikely to open. That is to say, high fixing strength is exhibited.

Other Embodiments

The technology disclosed in the present specification is not limited to the embodiments described by the above description and diagrams, and embodiments such as the following are also included within the technical scope.

Figure 10:
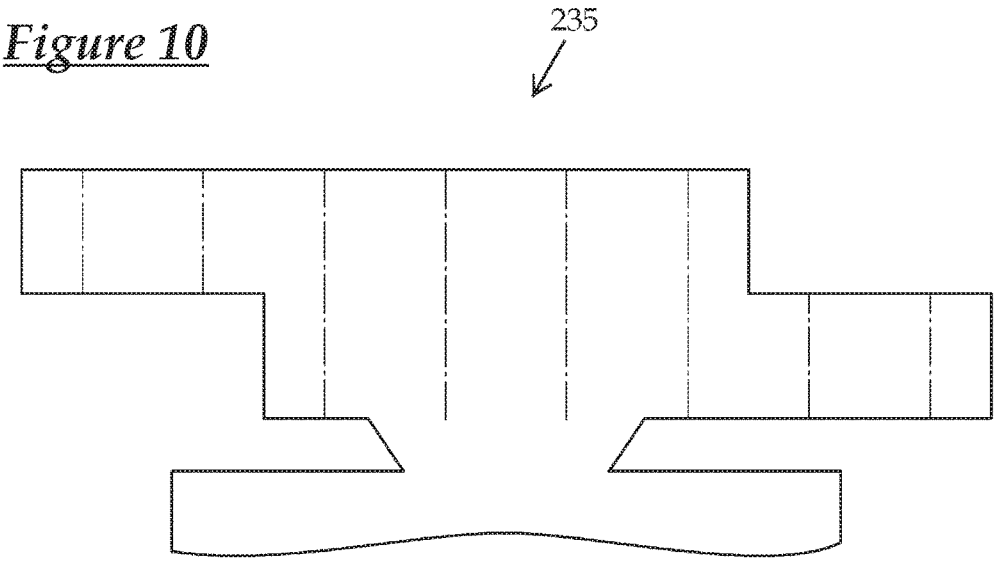
FIG. 10 is a laid-out plan view of a barrel portion of a terminal according to another embodiment.
Figure 11:
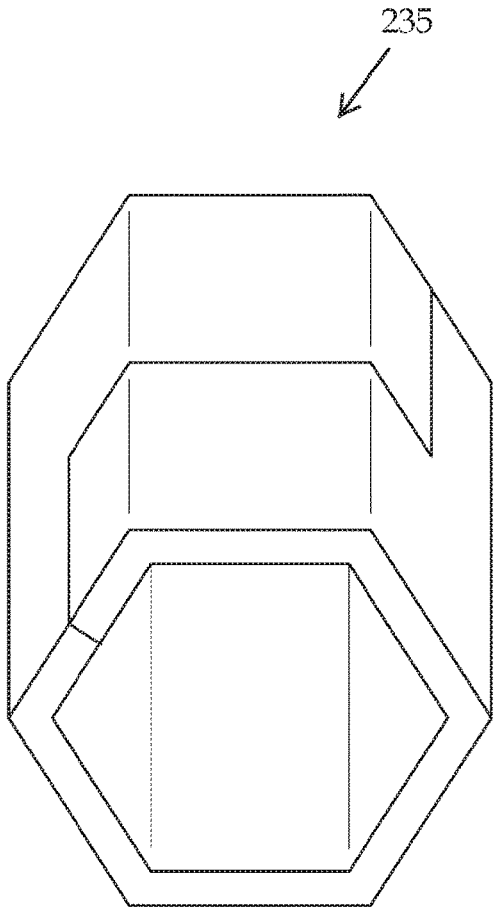
FIG. 11 is similarly a conceptual perspective view of the barrel portion in a wrapped state, shown from a rear side.
Figure 12:
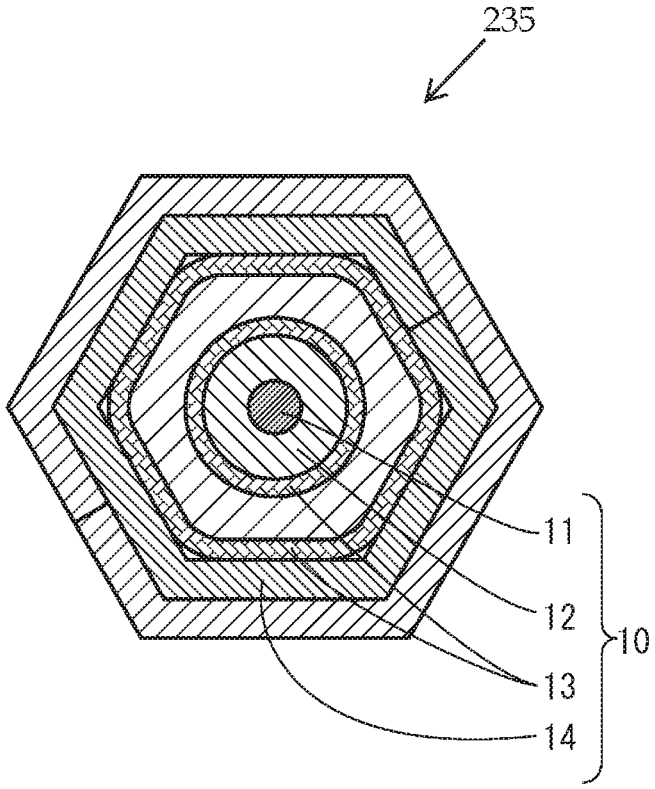
FIG. 12 is similarly a cross-sectional view of the barrel portion of the terminal.

In the above Embodiment 1, although an example was shown in which the barrel portion 35 of the terminal 20 is crimped to the shielded wire 10 into a rectangular tube shape (shape with a rectangular cross section), there is no limit to a rectangular tube shape, and crimping into a polygonal tube shape (cross-sectional polygon) such as a pentagonal tube, a hexagonal tube, or the like is also possible (see barrel portion 235 in FIGS. 10 to 12).

Figure 13:
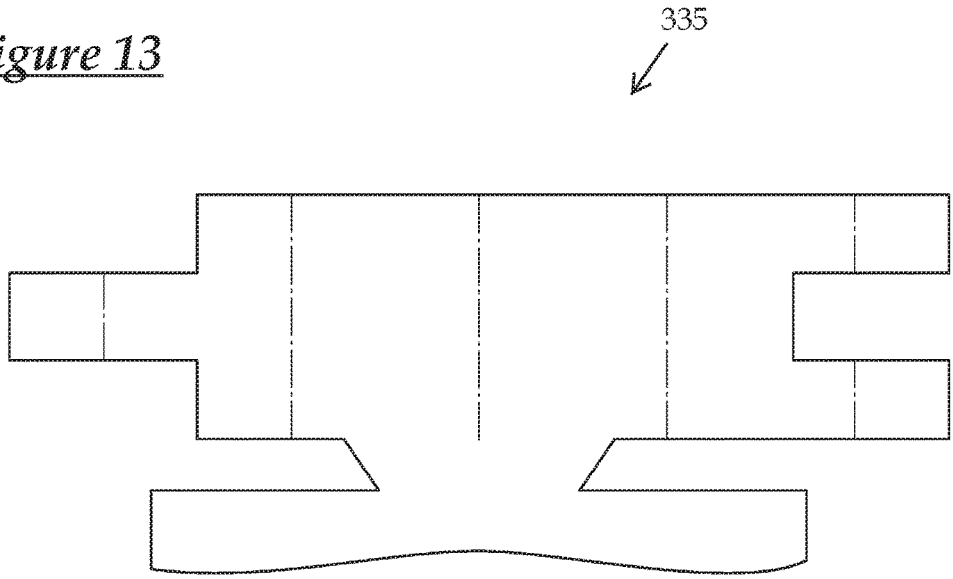
FIG. 13 is a laid-out plan view of a barrel portion of a terminal according to another embodiment.
Figure 14:
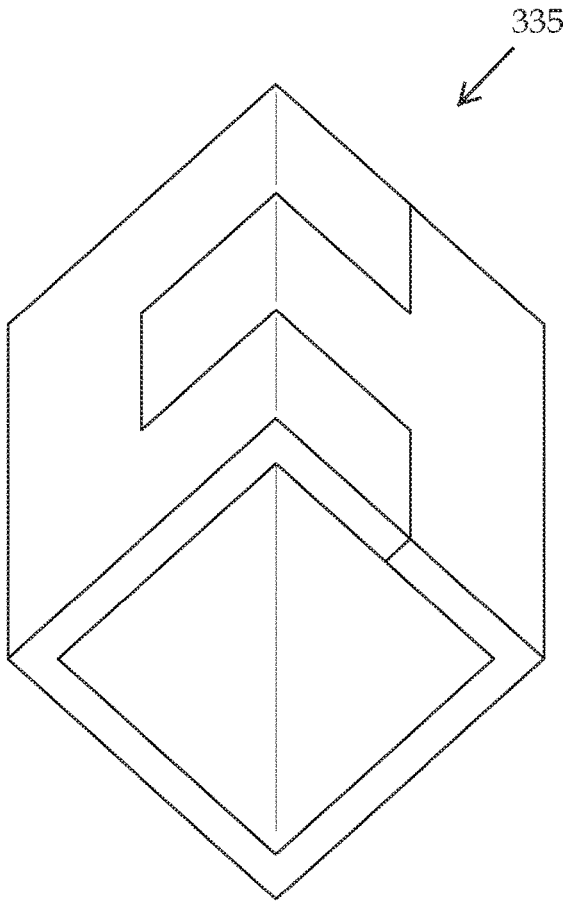
FIG. 14 is similarly a conceptual perspective view of the barrel portion in a wrapped state, shown from a rear side.
Figure 15:
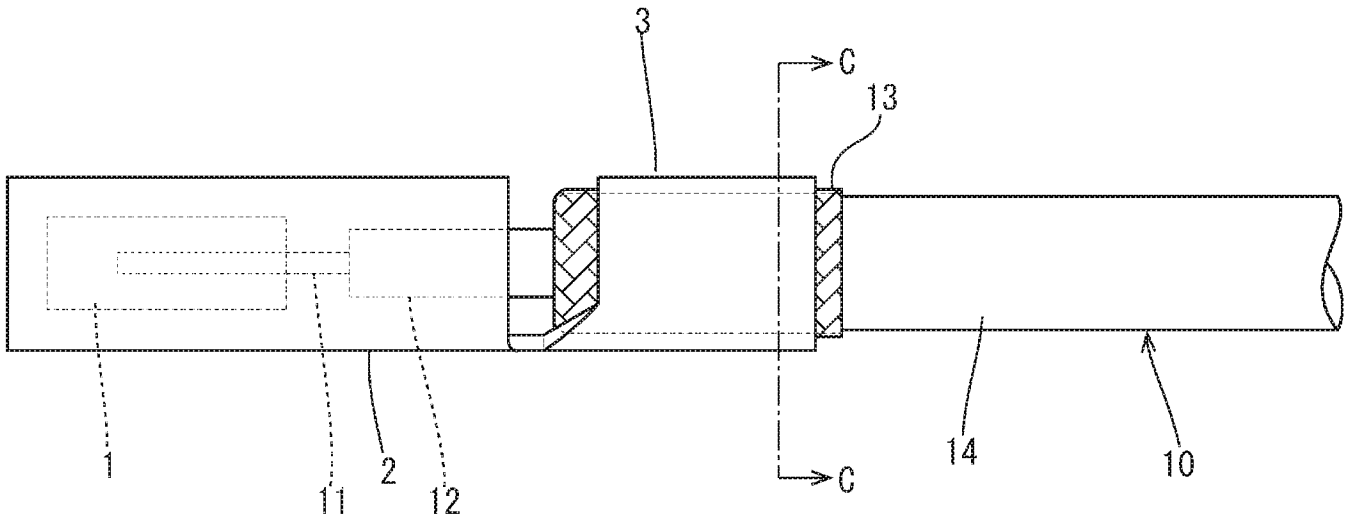
Figure 15 (Prior Art)
FIG. 15 is a side view showing a conventional terminal-equipped wire.
Figure 16:
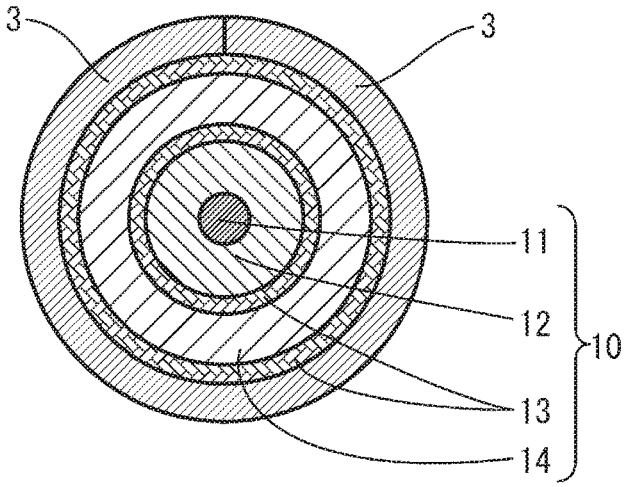
Figure 16 (Prior Art)
FIG. 16 is a cross-sectional view taken along line C-C in FIG. 15.
Figure 17:
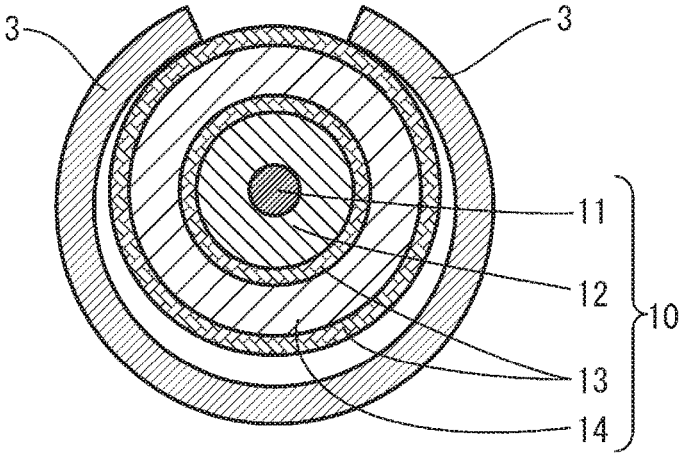
Figure 17 (Prior Art)
FIG. 17 is a cross-sectional view showing the conventional terminal in an open state.

In the above Embodiment 1, the edge portions on the leading end sides of the pair barrel pieces 37 and 38 and the pair of outer barrel pieces 42 and 43 are formed with a stair-like stepped shape, but the present invention is not limited to the above-embodiment, and may employ a mode such as that shown in the barrel portion 335 in FIGS. 13 and 14 in which protrusions and recessions match each other (fit each other). Also, the uneven shape of the abutting edge portions is not limited to being straight, and can take any shape such as a curved shape like a wave.

In Embodiment 1, a configuration is employed in which the leading end edges of the pair of barrel pieces 37 and 38 and the pair of outer barrel pieces 42 and 43 are arranged on opposite sides of a corner portion of the barrel portion 35, but a configuration may be employed in which they are arranged on opposite sides of two corner portions for example (see FIG. 11).

In the above Embodiment 1, a configuration is employed in which the abutting edge portions 37E and 38E of the barrel portion 35 and the leading end edges 42C and 43C of the outer barrel 40 are arranged at different positions in the circumferential direction of the shielded wire 10, but they are not necessarily required to be arranged at different positions.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMERALS

10 Shielded wire (wire)
11 Core wire
12 Internal insulating layer
13 Shield layer
14 External sheath
20 Terminal
21 Inner terminal
25 Dielectric (Insulator)
30 Outer terminal (terminal)
31 Fitting tube portion (housing portion)
32 Body portion (first member)
33 Lid portion (second member)
35 Barrel portion
37 First barrel piece
37C, 38C Leading end edge
37E, 38E Abutting edge portion
38 Second barrel piece
40, 80 Outer barrel
42 First outer barrel piece
43 Second outer barrel piece
45, 85 Corner portion
60 Wire
61 Core wire
64 Sheath
70 Terminal
75 Insulation barrel
77, 78 Insulation barrel piece (barrel piece)
100, 300 Terminal-equipped wire
X Extension direction of barrel
Y Extension direction of housing portion

The invention claimed is:

1. A terminal-equipped wire configured by crimping a pair of barrel pieces provided on a terminal to an external sheath of a wire, the external sheath being provided on an outer circumferential surface of a core wire, the pair of barrel pieces are wrapped around the external sheath into a polygonal tube shape that has a plurality of corner portions in a circumferential direction of the external sheath, and leading end edges of the pair of barrel pieces are arranged on opposite sides of at least one corner portion out of the plurality of corner portions, wherein mutually matching abutting edge portions of the pair of barrel pieces have an uneven shape on a leading end side in an extension direction of the pair of barrel pieces, wherein an outer barrel is crimped to the pair of barrel pieces from the outside, wherein a pair of leading end edges of the outer barrel are arranged on opposite sides of at least one corner portion out of the plurality of the corner portions, and wherein the abutting edge portions of the pair of barrel pieces and the pair of leading end edges of the outer barrel are arranged at different positions in a circumferential direction of the wire.

2. The terminal-equipped wire according to claim 1, wherein the wire includes a shield layer between the core wire and the external sheath, the shield layer is exposed at an end of the wire and folded back onto an outer circumferential surface of the external sheath, and the pair of barrel pieces are crimped to the external sheath via the shield layer.

3. The terminal-equipped wire according to claim 1, wherein the pair of barrel pieces overlap each other at leading end sides thereof.

4. A terminal-equipped wire configured by crimping a pair of barrel pieces provided on a terminal to an external sheath of a wire, the external sheath being provided on an outer circumferential surface of a core wire, the pair of barrel pieces are wrapped around the external sheath into a polygonal tube shape that has a plurality of corner portions in a circumferential direction of the external sheath, and leading end edges of the pair of barrel pieces are arranged on opposite sides of at least one corner portion out of the plurality of corner portions, wherein mutually matching abutting edge portions of the pair of barrel pieces have an uneven shape on a leading end side in an extension direction of the pair of barrel pieces, wherein an outer barrel is crimped to the pair of barrel pieces from the outside, wherein a pair of leading end edges of the outer barrel are arranged on opposite sides of at least one corner portion out of the plurality of the corner portions, wherein the terminal includes an inner terminal connected to the core wire, a dielectric that houses the inner terminal therein, and an outer terminal that has a housing portion that houses the dielectric, when divided along an extension direction of the housing portion, the housing portion of the outer terminal includes a first member and a second member, and wherein the pair of barrel pieces are provided integrated with the first member and the outer barrel is provided integrated with the second member.

* * * * *